US009540816B2

(12) United States Patent
Jenkins et al.

(10) Patent No.: US 9,540,816 B2
(45) Date of Patent: Jan. 10, 2017

(54) SYSTEM, METHOD AND APPARATUS FOR ROOFING PRODUCT WITH APPLIED SHADOW EFFECT

(71) Applicant: CertainTeed Corporation, Malvern, PA (US)

(72) Inventors: Robert L. Jenkins, Honey Brook, PA (US); Michael D. Shreve, Media, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/202,000

(22) Filed: Mar. 10, 2014

(65) Prior Publication Data

US 2014/0260047 A1 Sep. 18, 2014

Related U.S. Application Data

(60) Provisional application No. 61/777,218, filed on Mar. 12, 2013.

(51) Int. Cl.

| | |
|---|---|
| ***E04D 1/26*** | (2006.01) |
| *E04D 1/00* | (2006.01) |
| *B05D 5/06* | (2006.01) |

(52) U.S. Cl.

CPC . *E04D 1/26* (2013.01); *B05D 5/06* (2013.01); *B05D 2401/32* (2013.01); *E04D 2001/005* (2013.01); *Y10T 428/24273* (2015.01); *Y10T 428/24314* (2015.01)

(58) Field of Classification Search

CPC ..... E04D 1/26; E04D 2001/005

See application file for complete search history.

(56) References Cited

U.S. PATENT DOCUMENTS

| | | | | |
|---|---|---|---|---|
| 52,538 | A | 10/1918 | Lords | |
| 53,538 | A | 10/1918 | Lords | |
| 1,394,149 | A | 10/1921 | Cumfer et al. | |
| 1,773,117 | A * | 8/1930 | Rahr | 205/122 |
| 1,860,180 | A | 5/1932 | Horne | |
| 1,916,095 | A | 6/1933 | Cumfer | |
| 2,096,968 | A * | 10/1937 | Johnston | E04D 1/26 428/143 |
| 2,905,569 | A | 9/1959 | Zitke | |
| 5,347,785 | A * | 9/1994 | Terrenzio et al. | 52/555 |
| 5,375,387 | A * | 12/1994 | Davenport | 52/557 |
| 6,190,754 | B1 * | 2/2001 | Bondoc et al. | 428/143 |
| 6,212,843 | B1 * | 4/2001 | Kalkanoglu et al. | 52/555 |

(Continued)

*Primary Examiner* — Andrew J Triggs

(74) *Attorney, Agent, or Firm* — Abel Law Group, LLP; Alexander H. Plache

(57) ABSTRACT

A roofing shingle has a shingle body with at least a top layer having a buttlap portion with a butt edge and a headlap portion. An exposure zone extends from the butt edge toward the headlap portion is configured to be exposed to the environment when the roofing shingle is installed on a roof. A shadow formation may be located in the exposure zone of the top layer. The shadow formation and the exposure zone differ from each other in at least one aspect, such as color. The top layer may be substantially rectangular and have no tabs formed along the butt edge. A thickness of the exposure zone and a thickness of the shadow formation may be substantially identical. The shadow formation may be a simulated cut out, slit or slot.

15 Claims, 5 Drawing Sheets

(56) References Cited

U.S. PATENT DOCUMENTS

| | | | | |
|---|---|---|---|---|
| 6,715,252 | B2 * | 4/2004 | Stahl et al. | 52/557 |
| 7,665,261 | B2 * | 2/2010 | Elliott et al. | 52/557 |
| 2007/0068108 | A1 * | 3/2007 | Kiik et al. | 52/518 |
| 2013/0025226 | A1 * | 1/2013 | Jenkins et al. | 52/557 |
| 2014/0260047 | A1 * | 9/2014 | Jenkins et al. | 52/518 |

* cited by examiner

SYSTEM, METHOD AND APPARATUS FOR ROOFING PRODUCT WITH APPLIED SHADOW EFFECT

This application claims priority to and the benefit of U.S. Prov. App. No. 61/777,218, filed Mar. 12, 2013, which is incorporated herein by reference in its entirety.

BACKGROUND OF THE INVENTION

Field of the Disclosure

The present invention relates in general to roofing products and, in particular, to a system, method and apparatus for a roofing product with an applied shadow effect.

Description of the Related Art

Roofing products such as roofing shingle come in many different forms. Some of the more popular roofing shingles include thicker products or laminates of layers to give the shingle an enhanced, three-dimension effect. Other features enhance the visual appearance and aesthetics by cutting or otherwise removing portions of the roofing shingle to approximate natural material shakes and the like. However, material removal usually results in material waste which adds to the cost of the product. Accordingly, improvements in roofing products continue to be of interest.

SUMMARY

Embodiments of a system, method and apparatus for a roofing product with an applied shadow effect are disclosed. For example, a roofing shingle may comprise a shingle body having at least a top layer having a buttlap portion with a butt edge and a headlap portion. An exposure zone may extend from the butt edge toward the headlap portion and be configured to be exposed to the environment when the roofing shingle is installed on a roof. A shadow formation may be located in the exposure zone of the top layer.

Embodiments of the shadow formation and the exposure zone may differ from each other in color. In some embodiments, the top layer may be substantially rectangular and have no tabs formed along the butt edge. In still other embodiments, a thickness of the exposure zone and a thickness of the shadow formation may be substantially identical. Alternate embodiments may include the shadow formation as a simulated cut out, slit or slot.

Embodiments of an array of roofing shingles may have a first course underlying a second course on a roof. Each roofing shingle may comprise a shingle body comprising at least a top layer having a buttlap portion with a butt edge and a headlap portion. The exposure zone may extend from the butt edge toward the headlap portion and may be configured to be exposed to the environment when the roofing shingle is installed on a roof. The shadow formation may be located in the exposure zone of the top layer. The next course of roofing shingle may not overlay the exposure zone of the previous course of roofing shingle, and may only overlay the headlap portion, such that the shadow formation is completely unobstructed by the next course of roofing shingle.

Additional embodiments may comprise a method of manufacturing a roof shingle. The method may comprise applying a first type of granule to a limited portion of an exposure zone to form a shadow formation. The method may comprise applying a second type of granule to an entire surface area of the exposure zone, such that the second type of granule does not adhere to the limited portion of the exposure zone due to the presence of the shadow formation. The method also may comprise removing excess of the second type of granule from the shadow formation. The first and second types of granules can differ from each other in at least one aspect.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
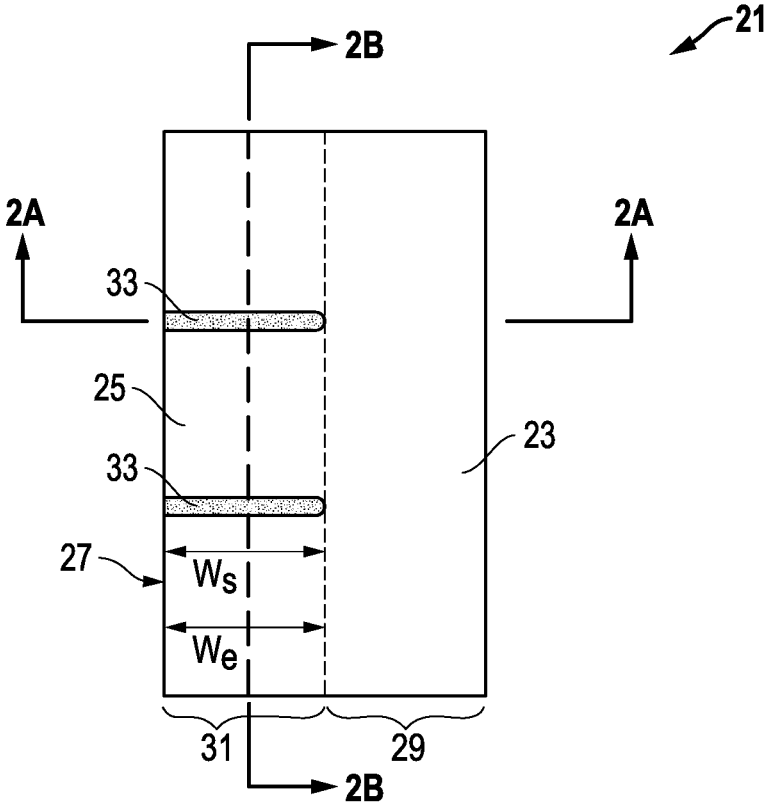
FIG. 1 is a schematic plan view of an embodiment of a roofing product.

Embodiments of a system, method and apparatus for a roofing product with an applied shadow effect are disclosed. For example, a roofing shingle 21 (FIGS. 1 and 2) may comprise a shingle body 23 comprising at least a top layer having a buttlap portion 25 with a butt edge 27 and a headlap portion 29 comprising a portion of the roofing shingle that is not visible when the roofing shingle is installed on a roof with other shingles. An exposure zone 31 may extend from the butt edge 27 toward the headlap portion 29. The exposure zone 31 may be configured to be exposed to the environment when the roofing shingle 21 is installed on a roof. The exposure zone may include the portion of the roofing shingle that is visible when the roofing shingle is installed on a roof with other roofing shingles. The roofing shingle 21 may further comprise one or more sealants as is known in the art.

Figure 2A:
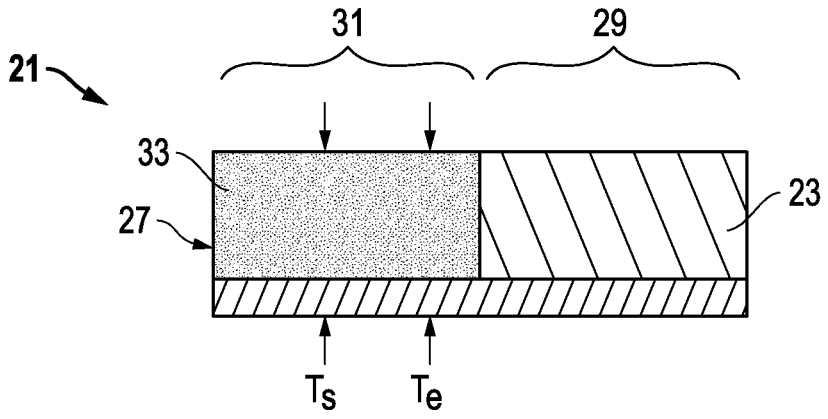
FIGS. 2A and 2B are sectional end and side views of the roofing product of FIG. 1 taken along the lines 2A-2A and 2B-2B, respectively, of FIG. 1.
Figure 2B:
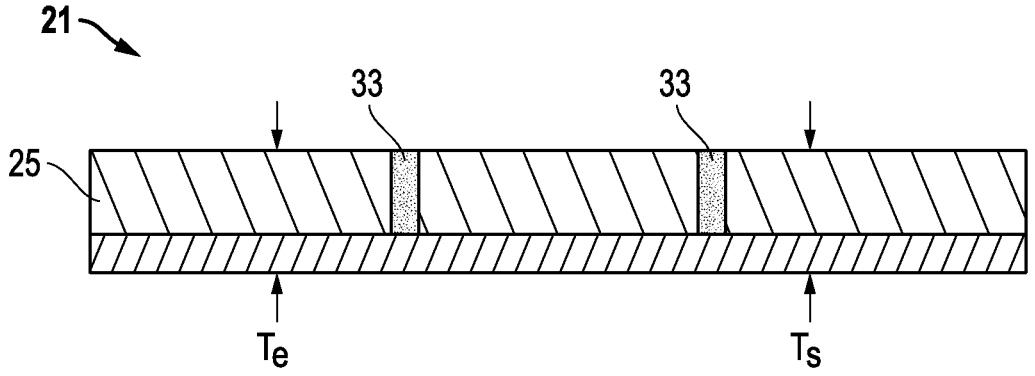

The roofing shingle 21 may further comprise one or more shadow formations 33 (two are shown in FIG. 1) in the exposure zone 31 of the top layer. As shown in FIGS. 1-3, the shadow formations 33 are a type of topical feature in the exposure zone 31. A topical feature may be defined as a visible element in the exposure zone when the roofing shingle is installed on a roof with other roofing shingles. Embodiments may include no other layers or topical features on top of the top layer. Thus, in the exposure zone 31, the topical feature may consist only of the shadow formations 33. The shadow formation 33 may have a width Ws that is equal to or less than a width We of the exposure zone 31.

In some examples, the shadow formation 33 may vary in width by at least about 2%, such as at least about 5%, at least about 10%, or even at least about 20%. In other examples, the shadow formation 33 may vary in width by not greater than about 50%, such as not greater than about 40%, not greater than about 30%, or even not greater than about 25%.

In one example, the shadow formation 33 may comprise at least 2% of a surface area of the exposure zone 31. In another example, the shadow formation 33 may be not greater than about 50% of the surface area of the exposure zone 31.

Embodiments of the top layer may be substantially rectangular as shown, with no tabs formed along the butt edge 27. The term "tab" may be defined as a geometric formation, such as a rectangular extension, that is typically formed in the buttlap portion by removal of material (i.e., forming a cut out) along the butt edge, such that the material remaining is the tab (e.g., tabbed shingles, dragon tooth shingles, etc.).

In some embodiments, a thickness Te (FIGS. 2A and 2B) of the exposure zone 31 and a thickness Ts of the shadow formation 33 are substantially identical. For example, the thicknesses Te and Ts may be within about 0.1 inch of each other, such as within about 0.01 inch of each other, or even within about 0.001 inch of each other.

In other embodiments, the shadow formation may comprise a simulated cut out, slit or slot. The terms "cut out", "slit" and "slot" may be defined as materials removed from the buttlap portion of a conventional roofing product, such as a rectangular block, narrow cut, or wide cut, respectively. The removed materials are typically geometric (e.g., rectangular) formations.

Accordingly, embodiments of roofing shingle 21 may comprise a top layer that is substantially rectangular with no slits, slots, cut outs or other apertures formed therein, such that the top layer has no portions removed therefrom. Moreover, embodiments of the shadow formation 33 may not have any material removed (e.g., a slit, slot or cut out) such that it is not interrupted into smaller portions by apertures in the top layer.

Figure 3A:
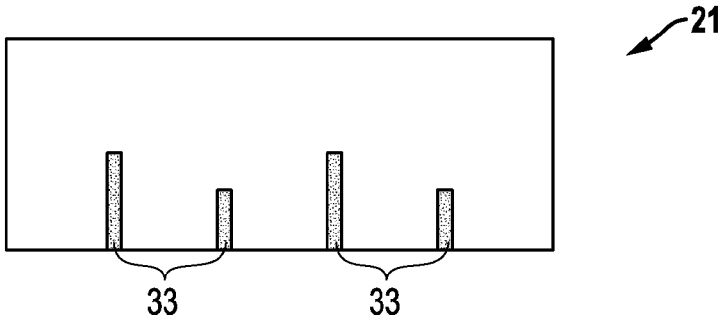
FIGS. 3A-3D depict plan view of various embodiments of roofing products.
Figure 3B:
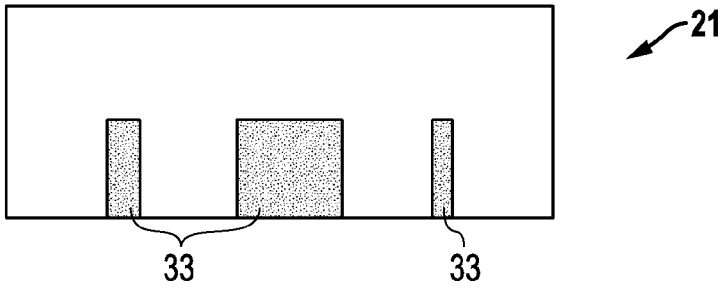

As shown in FIG. 1, embodiments of the shadow formations 33 may be at least one of uniform and symmetrical. However, other embodiments of the shadow formations 33 (see, e.g., FIGS. 3A-3D) may be at least one of non-uniform and asymmetrical. For example, FIG. 3A depicts shadow formations 33 of varying lengths, while FIG. 3B depicts shadow formations 33 of varying widths. At least one of the shadow formations 33 may have a different width in a width direction. The shadow formation 33 may or may not extend into the headlap portion 29.

Figure 3C:
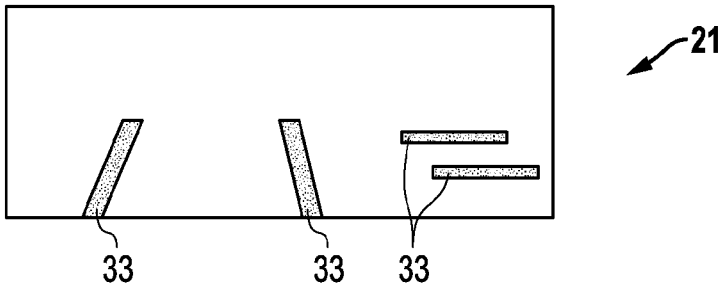
Figure 3D:
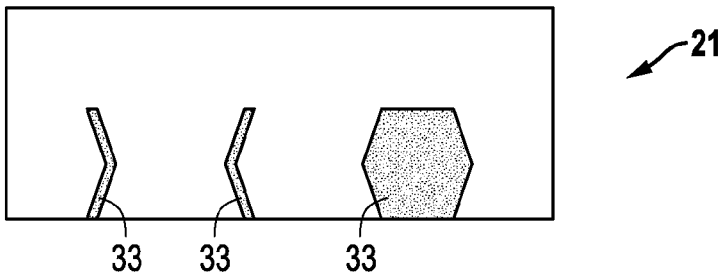

FIGS. 3C and 3D illustrate shadow formations 33 of at various angles and geometric patterns. Any combination of these embodiments also may suitable for some applications. Moreover, the shadow formation 33 comprises a plurality of shadow formations 33, at least two of which may differ from each other in at least one aspect (e.g., location, shape, orientation, color, etc.). At least one of the shadow formations 33 may be discontinuous or interrupted in at least one of the width direction and a length direction.

The shadow formation 33 may have at least one component that is straight, curved or has a geometric shape, profile or design, or is a combination of multiple geometric shapes. The shadow formation 33 may be continuous and oscillate or vary in width in a length direction.

The shadow formation 33 and the exposure zone 31 may differ from each other in color. A "color" of granules may comprise a single color or a mixture of two or more types of granules of different colors to make an overall blend color. More than one blend may be used on areas of a roofing product.

Further regarding coloration of the granules, CIELAB is the second of two systems adopted by CIE in 1976 as models that better showed uniform color spacing in their values. CIELAB is an opponent color system based on the earlier (1942) system of Richard Hunter called L, a, b. Color opposition correlates with discoveries in the mid-1960s that somewhere between the optical nerve and the brain, retinal color stimuli are translated into distinctions between light and dark, red and green, and blue and yellow. CIELAB indicates these values with three axes: L*, a*, and b*. The full nomenclature is 1976 CIE L*a*b* Space. A central vertical axis represents lightness (signified as L*) whose values run from 0 (black) to 100 (white). The color axes are based on the fact that a color cannot be both red and green, or both blue and yellow, because these colors oppose each other. On each axis the values run from positive to negative. On the a-a' axis, positive values indicate amounts of red while negative values indicate amounts of green. On the b-b' axis, yellow is positive and blue is negative. For both axes, zero is neutral gray.

In some embodiments, the shadow formation 33 and the exposure zone 31 may differ from each other in color by at least about 2 L* CIE color units, such as at least about 5 L* CIE color units, at least about 10 L* CIE color units, or even at least about 15 L* CIE color units. In other examples, the first and second shadowlines may differ from each other in color by not greater than about 50 L* CIE color units, such as not greater than about 40 L* CIE color units, not greater than about 30 L* CIE color units, or even not greater than about 20 L* CIE color units. The color differential also may be within a range defined by any of these minimum and maximum values. Furthermore, the shadow formation can be darker or lighter than the exposure zone.

Embodiments of the roofing shingle 21 may further comprise a color separation or space between at least two of the shadow formations 33 in a color similar to a primary blend or a complementary color of the exposure zone 31. In other examples, at least one of the shadow formations 33 varies in color and goes from darker to lighter, or lighter to darker, in a width direction. The shadow formation 33 may have a tone or color that is repeated with either a darker or lighter color tone as a separation therebetween in a length direction. The exposure zone 31 may comprise a primary shingle color comprising one or more blend tones, and the shadow formation 33 may intersect the butt edge 27 of the exposure zone 31 adjacent the primary shingle color.

It will be understood that the color contrast between the shadow formations 33 and the exposure zones 31 may be in either lightness or darkness, but also may include a chromatic aspect. The color contrast may be measured as a difference in at least one of the L*, a* or b* values. Thus, in some embodiments, the shadow formation 33 and the exposure zone 31 may differ from each other in color by at least about 2 CIE color units, such as at least about 5 CIE color units, at least about 10 CIE color units, or even at least about 15 CIE color units. In other examples, the shadow formation and exposure zones may differ from each other in color by not greater than about 50 CIE color units, such as not greater than about 40 CIE color units, not greater than about 30 CIE color units, or even not greater than about 20 CIE color units. The color differential also may be within a range defined by any of these minimum and maximum values. Furthermore, the shadow formation can be darker or lighter than the exposure zone, or can differ chromatically from the exposure zone. The color difference can also be expressed as $\Delta E^*$, where $\Delta E^*$ is the square root of the sum of the squares of the differences in each of the L*, a*, b* values for a pair of color measurements. That is to say that for two colors 1 and 2, measured as $L^*_1$, $a^*_1$, $b^*_1$ and $L^*_2$, $a^*_2$, $b^*_2$, $\Delta E^*=$ $(\Delta L^{*2}+\Delta a^{*2}+\Delta b^{*2})^{0.5}=((L^*_1-L^*_2)^2+(a^*_1-a^*_2(b^*_1-b^*_2)^2)^{0.5}$ Thus, in some embodiments, the shadow formation 33 and the exposure zone 31 may differ from each other in color by a ΔE* of at least about 2 units, such as at least about 6 units, at least about 11 units, or even at least about 17 units. In other examples, the shadow formation and exposure zones may differ from each other in color by a ΔE* of not greater than about 47 units, such as not greater than about 39 units, not greater than about 28 units, or even not greater than about 19 units. The color differential also may be within a range defined by any of these minimum and maximum values.

In some versions of the roofing shingle 21, the shingle body may be formed from a material that is bituminous, thermoplastic, thermoset polymer, metallic, recycled material, cementitious or a combination thereof. The roofing shingle 21 may comprise a single layer and may not comprise a laminate. However, the roofing shingle 21 may comprise a laminate having more than one layer. The roofing shingle 21 may comprise embodiments with an exposure zone 31 having a first type of granule, and the shadow formation 33 may comprise a second type of granule that differs from the first type of granule.

In some embodiments, a next course of roofing shingle 21 may not overlay the exposure zone 31 of a previous course of roofing shingle 21, and may only overlay the headlap portion 29, such that the shadow formation 33 is completely unobstructed by the next course of roofing shingle 21. Thus, an array of roofing shingles 21 may have a first course underlying a second course on a roof. Each roofing shingle 21 may comprise a shingle body 23 comprising at least a top layer having buttlap portion 25 with butt edge 27 and headlap portion 29. The exposure zone 31 may extend from the butt edge 27 toward the headlap portion 29 and may be configured to be exposed to the environment when the roofing shingle 21 is installed on a roof. The shadow formation 33 may be located in the exposure zone 31 of the top layer. The shadow formation 33 may be configured as described herein.

Embodiments of the next course of roofing shingle 21 may not overlay the exposure zone 31 of the previous course of roofing shingle 21 and may only overlay the headlap portion 29, such that the shadow formation 33 is completely unobstructed by the next course of roofing shingle 21. The various components of the roofing shingles 21 may be configured as described elsewhere herein for the various embodiments.

Figure 4:
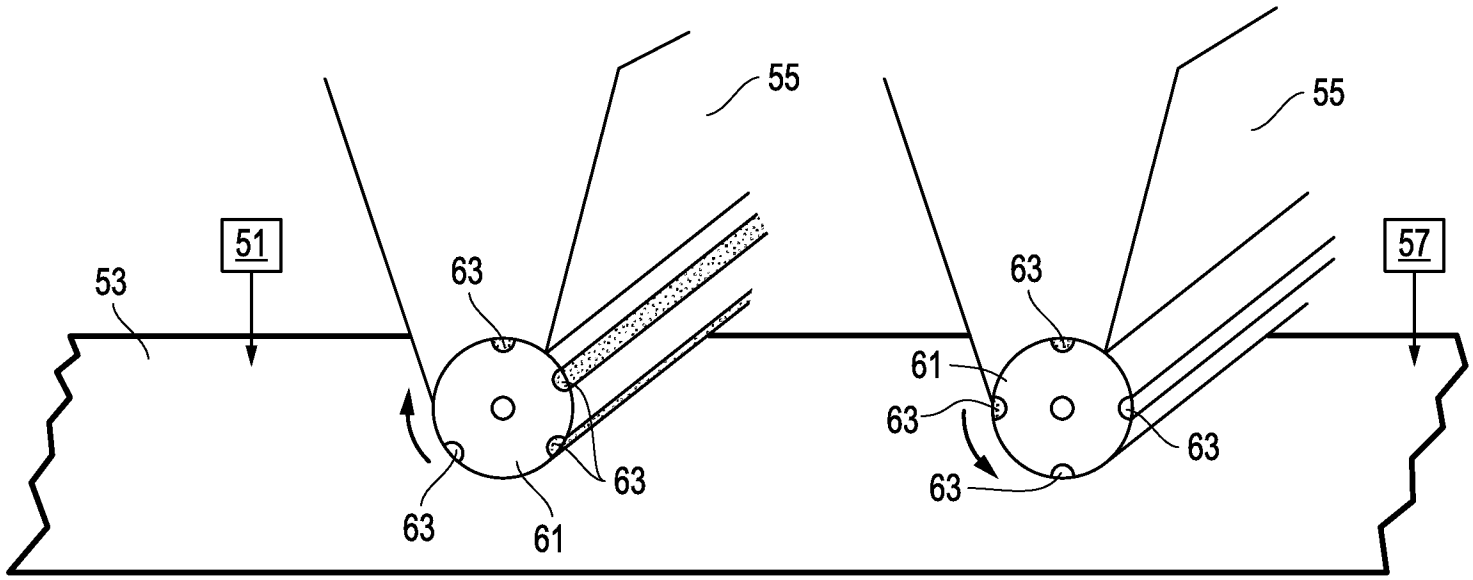
FIGS. 4-6 are schematic isometric views of embodiments of a manufacturing process, method and equipment for fabricating roofing products.
Figure 5:
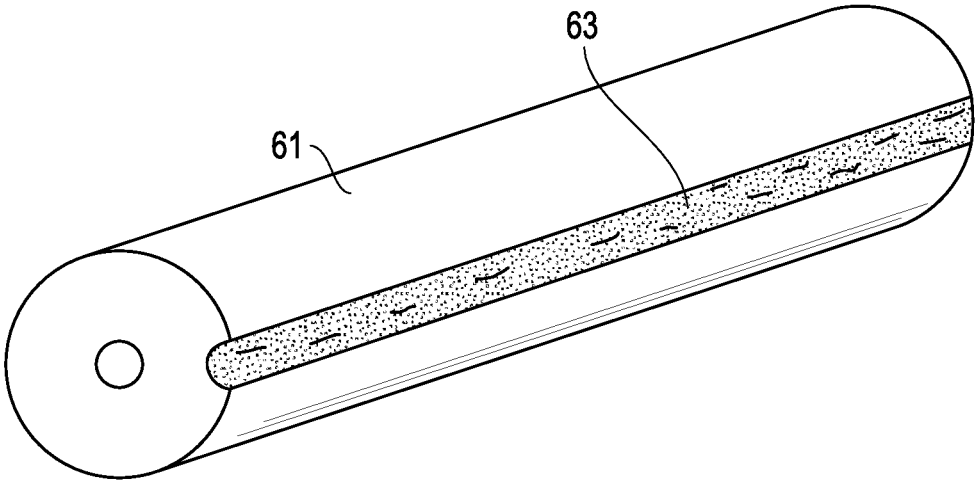
Figure 6:
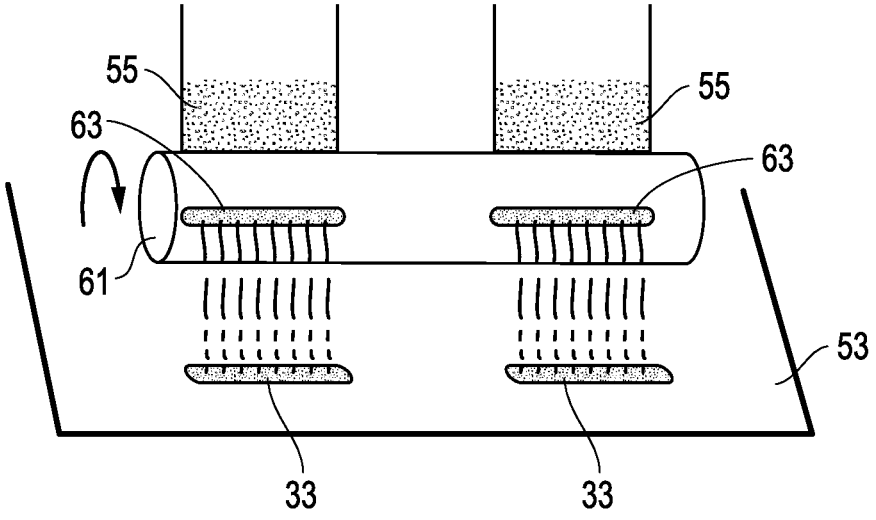

Additional embodiments may comprise a method of manufacturing a roof shingle. See, e.g., FIGS. 4-6. The method may comprise forming a shingle body 23 comprising at least a top layer having a buttlap portion 25 with a butt edge 27, a headlap portion 29, an exposure zone 31 extending from the butt edge 27 toward the headlap portion 29. The method may comprise applying a first type of granule 55 to a limited portion of the exposure zone 31 to form a shadow formation 33. The method may comprise applying a second type of granule 57 to an entire surface area of the exposure zone 31, such that the second type of granule does not adhere to the limited portion of the exposure zone 31 due to the presence of the shadow formation 33. The method also may comprise removing excess of the second type of granule from the shadow formation 33, such as by gravity discharge. The first and second types of granules 55, 57 can differ from each other in color, as described herein.

Embodiments of the method may further comprise applying asphalt 51 to a substrate 53 prior to applying the first and second types of granules 55, 57. In some embodiments, the second type of granule 57 has a larger size than openings between particles of the first type of granule 55. The first type of granule 55 may be selectively applied to the limited portion of the exposure zone 31 with a roller 61 having one or more patterned apertures 63 in which the first type of granule 55 is loaded prior to application. The patterned apertures 63 may be substantially identical in shape to the shadow formations 33. Alternatively, the apertures 63 may differ in shape from the shadow formations 33, but be shaped such that a shadow formation of a desired configuration is delivered to the asphalt-coated substrate 53.

Embodiments of the patterned aperture 63 may comprise a plurality of patterned apertures 63, at least two of which may differ from each other in at least one aspect. Similarly, the shadow formation 33 may comprise a plurality of shadow formations 33, at least two of which differ from each other in at least one aspect. In some embodiments of the method, wherein the shadow formation 33 is not masked prior to applying the second type of granule 55. The various components of the roofing shingle 21 may be configured as described elsewhere herein.

Embodiments of a roofing shingle may include an applied shadow effect that serves to enhance the visual appearance and aesthetics by pre-determined placement of color contrasting granular mineral matter so as to approximate a natural narrow shadow or pre-determined highlighted visual effect.

Another advantage to this approach is a material savings. For example, "cutout material" that is traditionally removed in a tabbed asphalt roofing shingle to yield a definition of shape can be simulated or replaced with an applied shadow effect resulting in no material or cutout waste as a cost savings.

Embodiments of a process and method may include a unique applicator roll with at least one pre-determined pocket, or an elongated cup shaped area or recessed area. These features may include short and long dimensions that can collect and apply a granular mineral matter in a relative defined shape to the asphaltic sheet or membrane in the process of the manufacture of a roofing product.

In some versions, the pre-determined pocket, elongated cup-shaped area or recessed area formed in part of a fixed applicator roll can have one or more shape designs and/or dimensions so as to yield one or more multiple shadow effects if desired when applied to a production sheet or membrane.

In other versions, the pre-determined pocket, elongated cup-shaped area or recessed area formed in part of a fixed roll can have one uniform shape, design and/or dimension so as to yield a repeatable or constant shadow effect (if desired), such as in the shape of a cutout that can be a narrow rectangular area having an acicular ratio.

Embodiments of the applicator roll can turn at a pre-determined rotation angle and/or desired position to drop out granular mineral matter that can be oriented in a variety of configurations. For example, the configurations may be perpendicular to the sheet direction, set at a pre-determined angle to the sheet direction, oriented in the sheet direction, or any combination thereof.

In some versions, one or more unique applicator rolls may be spaced across the sheet to accommodate multiple shingle product lanes. These may be spaced perpendicular to the sheet, at a predetermined angle to the sheet, oriented in the sheet direction, or any combination thereof.

Embodiments of a unique applicator roll may be used across the sheet and have within that roll spaced or intermittent pre-determined pockets, elongated cup-shaped areas or recessed areas as part of that fixed roll for uniform and/or variable-shaped designs and/or dimensions.

Other embodiments of a unique applicator roll with at least one pre-determined pocket, elongated cup-shaped area or recessed area can include various geometric shapes or designs for pre-determined visual effect. For example, those features may include sharp edges or demarcations, rough, feathered or fuzzy edges, various widths, various lengths, or any combination thereof.

In addition, shadow effect appearance can be accomplished with contrasting color where one or more individual granular like colors are used or mixed. Other versions of shadow effect appearance can be darker than the surrounding material, or lighter than the surrounding material.

The mineral matter may comprise coarse or fine particles of one or more colors or color types and/or shapes or sizes. In addition to mineral matter, granular-shaped polymeric material may be used.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A roofing shingle, comprising:

a shingle body comprising at least a top layer having a buttlap portion with a butt edge, a headlap portion comprising an entirety of the roofing shingle that is not visible when the roofing shingle is installed on a roof with other shingles, an exposure zone extending from the butt edge toward the headlap portion that is configured to be exposed to an environment, and the exposure zone comprises an entirety of the roofing shingle that is visible when the roofing shingle is installed on a roof with other roofing shingles;

a shadow formation differing in color from the exposure zone, only the exposure zone comprises the shadow formation, such that the headlap portion does not comprise the shadow formation, and the shadow formation comprises a shadow feature that consists of:

at least one of a simulated cut out, a simulated slit and a simulated slot, and there is no other shadow formation in the exposure zone of the top layer.

2. The roofing shingle of claim 1, wherein a next course of roofing shingle is configured to not overlay the exposure zone of a previous course of roofing shingle and only overlays the headlap portion, such that the shadow formation is completely unobstructed by the next course of roofing shingle; and the top layer is substantially rectangular and has no slits, slots, cut outs or other apertures formed therein, such that the top layer has no portions removed therefrom.

3. The roofing shingle of claim 1, wherein the shadow formation and the exposure zone differ from each other in color by at least about 2 L* CIE color units and not greater than about 50 L* CIE color units; and the shadow formation does not have any material removed such that it is not interrupted into smaller portions by apertures in the top layer.

4. The roofing shingle of claim 1, wherein the shadow formation varies in width by at least about 2%, and not greater than about 50%, and a thickness of the exposure zone and a thickness of the shadow formation are substantially identical; and the top layer has no tabs formed along the butt edge.

5. The roofing shingle of claim 1, wherein the shadow formation comprises at least 2% of a surface area of the exposure zone, and not greater than about 50% of the surface area of the exposure zone, and the shadow formation oscillates or varies in width in a length direction.

6. The roofing shingle of claim 1, wherein the roofing shingle comprises a single layer and does not comprise a laminate.

7. The roofing shingle of claim 1, wherein the roofing shingle comprises a laminate having more than one layer.

8. The roofing shingle of claim 1, wherein the shadow formation is at least one of non-uniform or asymmetrical in shape.

9. An array of roofing shingles having a first course underlying a second course on a roof, each roofing shingle comprising:

a shingle body comprising at least a top layer having a buttlap portion with a butt edge, a headlap portion comprising an entirety of the roofing shingle that is not visible when the roofing shingle is installed on a roof with other shingles, an exposure zone extending from the butt edge toward the headlap portion that is configured to be exposed to an environment, and the exposure zone comprises an entirety of the roofing shingle that is visible when the roofing shingle is installed on a roof with other roofing shingles, the exposure zone comprises a width extending in a width direction, and a length extending in a length direction that is perpendicular to the width direction;

the top layer has no slits, slots, cut outs or other apertures formed therein, such that the top layer has no portions removed therefrom;

a shadow formation differing in color from the exposure zone, only the exposure zone comprises the shadow formation, such that the headlap portion does not comprise the shadow formation, and the shadow formation comprises a topical feature consisting of:

a plurality of shadow features, each of the shadow features comprises a shadow feature width that is equal to or less than the width of the exposure zone, and each of the shadow features comprises a shadow formations feature length that is less than the length of the exposure zone; and the array further comprises:

a next course of roofing shingle does not overlay the exposure zone of a previous course of roofing shingle and only overlays the headlap portion, such that the shadow features are completely unobstructed by the next course of roofing shingle.

10. The array of claim 9, wherein a thickness of the exposure zone and a thickness of the shadow formation are substantially identical, and the top layer has no tabs formed along the butt edge.

11. The array of claim 9, wherein the shadow features comprise at least one of a simulated cut out, a simulated slit and a simulated slot, and there is no other shadow formation in the exposure zone of the top layer.

12. The array of claim 9, wherein the shadow formation comprises at least 2% of a surface area of the exposure zone, and not greater than about 50% of the surface area of the exposure zone;

the shadow formation does not have any material removed such that the shadow formation is not interrupted into smaller portions by apertures in the top layer; and the shadow formation oscillates or varies in width in the length direction.

13. The array of roofing shingles of claim 9, wherein at least one of the shadow features is at least one of non-uniform or asymmetrical in shape.

14. The array of roofing shingles of claim 9, wherein each of the roofing shingles comprises a single layer, such that the roofing shingles do not comprise laminates.

15. A roofing shingle, comprising:

a shingle body comprising at least a top layer having a buttlap portion with a butt edge, the top layer has no tabs formed along the butt edge, a headlap portion comprising an entirety of the roofing shingle that is not visible when the roofing shingle is installed on a roof with other shingles, an exposure zone extending from the butt edge toward the headlap portion that is configured to be exposed to an environment, and the exposure zone comprises an entirety of the roofing shingle that is visible when the roofing shingle is installed on a roof with other roofing shingles;

a shadow formation differing in color from the exposure zone, only the exposure zone comprises the shadow formation, such that the headlap portion does not comprise the shadow formation, and the shadow formation comprises a topical feature consisting of:

at least one shadow feature in the exposure zone of the top layer, the at least one shadow feature has a width that is equal to or less than a width of the exposure zone, and a thickness of the exposure zone and a thickness of the at least one shadow feature are substantially identical; and the at least one shadow feature consists of at least one of a simulated cut out, a simulated slit and a simulated slot, and there is no other shadow formation in the exposure zone of the top layer.

* * * * *